US005780212A

United States Patent [19]

Roussilhe et al.

[11] Patent Number: 5,780,212

[45] Date of Patent: Jul. 14, 1998

[54] PHOTOGRAPHIC DEVELOPING COMPOSITION

[75] Inventors: Jacques Roussilhe, Virey, France; Siu C. Tsoi, Watford, England

[73] Assignee: Eastman Kodak Company, Rochester, N.Y.

[21] Appl. No.: 881,408

[22] Filed: Jun. 24, 1997

[30] Foreign Application Priority Data

Jun. 24, 1996 [FR] France ..... 96 08149

[51] Int. Cl.[6] ..... G03C 5/30

[52] U.S. Cl. ..... 430/466; 430/438; 430/440; 430/446; 430/466; 430/481; 430/483

[58] Field of Search ..... 430/440, 446, 430/480, 483, 466, 481, 438

[56] References Cited

U.S. PATENT DOCUMENTS

| | | | |
|---|---|---|---|
| 3,865,591 | 2/1975 | Katz | 430/437 |
| 4,266,002 | 5/1981 | McCreary et al. | 430/218 |
| 5,098,819 | 3/1992 | Knapp | 430/483 |
| 5,194,367 | 3/1993 | Yamada et al. | 430/440 |
| 5,264,323 | 11/1993 | Purol et al. | 430/440 |
| 5,376,510 | 12/1994 | Parker et al. | 430/440 |

*Primary Examiner*—Hoa Van Le

*Attorney, Agent, or Firm*—J. Lanny Tucker

[57] ABSTRACT

The present invention concerns a developer for silver halide photographic products comprising a co-developing agent of the 1-phenyl-3-pyrazolidinone type. These co-developing agents comprise solubilizing groups which are not attached directly to the phenyl ring or the pyrazolidine ring, and improve the stability of the developer composition.

8 Claims, 2 Drawing Sheets

PHOTOGRAPHIC DEVELOPING COMPOSITION

FIELD OF THE INVENTION

The present invention concerns photography and novel compounds of the 3-pyrazolidinone type used for the development of silver halide photographic products, in particular as co-developing agents for developing black-and-white photographic films or papers.

BACKGROUND OF THE INVENTION

Developing agents are described in *Chimie et Physique Photographiques*, P Glafkides, Chapter IX, pages 152–170, fifth edition. In general a main developing agent is used in association with an auxiliary developing agent. In certain cases, a synergetic effect is observed between the main developing agent, referred to hereinafter as the "first developing agent", and the auxiliary developer or "co-developing agent". That is to say, the combined activity of the mixture of these two agents is greater than the sum of the activities of each of these agents used separately in the same solution. This phenomenon, called "superadditivity", is explained in Mason, "*Photographic Processing Chemistry*", Focal Press, London, 1975.

Polyphenols, for example hydroquinone, and reductones, for example compounds of the ascorbic acid type, are the most widely used developers in practice in black-and-white developing solutions.

The most frequently used co-developing agents include the aminophenols, such as Elon® (methyl-p-aminophenol sulfate), the 1-phenyl-3-pyrazolidinones or Phenidones, such as Phenidone-A (1-phenyl-3-pyrazolidinone), Phenidone-B (1-phenyl-4 methyl-3-pyrazolidinone), Dimezone (1-phenyl-4,4'dimethyl-3-pyrazolidinone), Dimezone-S (1-phenyl-4-methyl-4'-hydroxymethyl-3-pyrazolidinone). Additional representative examples of aminophenols and phenidones are described in U.S. Pat. Nos. 2,688,549, 2,691,589, 3,865,591, 4,269,929, 4,840,879 and 5,236,816, and in the article by G E Ficken and B G Sanderson, *The Journal of Photographic Science*, Vol 11, 1963, pages 157–164.

Co-developing agents with improved solubility in water are desirable in order to facilitate the manufacture of the developer, or its ease of use. In particular, photographic processing solutions are often packaged in the form of powders to be dissolved in water or concentrated liquids to be diluted before use. These concentrates must be easily soluble.

EP 528,480 describes a radiographic product comprising a 3-pyrazolidinone substituted by a carboxy group directly attached to the phenyl ring. This compound is used as an anti-fog agent. The radiographic product is developed with a conventional developer comprising hydroquinone and a 1-phenyl-pyrazolidine-1-one co-developing agent.

In view of the low solubility of Phenidone or Dimezone-S, U.S. Pat. No. 4,753,869 proposed that these 1-phenyl-3-pyrazolidinones be prepared in the form of salts of four particular acids including sulfo groups which dissolve easily in water and are stable during storage. The activity of these compounds in combination with hydroquinone is said to be comparable with that of pyrazolidinones which are not in the form of salts.

The article in *Zhurnal Nauchnoi i Prikladnoi Fotografii i kinematografii* 10, (5), 321–329 (1963) by V L Abritalin et al describes photographic developers comprising hydroquinone and very many derivatives of 3-pyrazolidinones, some of which have solubilizing groups fixed directly on the benzene ring. According to this publication, the introduction of solubilizing carboxy or sulfo groups to the benzene ring leads to a large decrease in superadditivity. This tendency is also noted by G E Ficken and B G Sanderson, in *The Journal of Photographic Science*, Vol 11, 1963, pages 157–160, who report that the introduction of a carboxylic group to the phenidone reduces the superadditivity of the Phenidone/hydroquinone mixtures.

Developers based on hydroquinone generally yield good results but present drawbacks with regard to environmental concerns. That is why ascorbic acid has been recommended in place of hydroquinone in association with phenidones in developing compounds described in numerous patents.

Among these, U.S. Pat. No. 5,098,819 describes a developing compound comprising ascorbic acid or its derivatives, and a 3-pyrazolidinone. The developer in the examples contains sodium erythorbate, Phenidone or Dimezone-S and potassium carbonate. This developing compound is less toxic than those containing hydroquinone and caustic bases and the sensitometric results are close to those obtained with compositions containing hydroquinone.

U.S. Pat. No. 3,938,997 describes a developer for the rapid development of high-contrast products of the microfilm type. This developer comprises three developing agents: the first is a ferrous iron chelate, the second is a compound of the ascorbic acid type, the third is Phenidone, glycine, hydroxylamine sulfate etc. Developing solutions are obtained which can be easily concentrated.

EP 588,408 describes a developing composition comprising a main developer of the ascorbic acid type and a mixture of two co-developing agents of the phenidone type selected from Phenidone-A, Phenidone-B, Dimezone and Demizone-S. The developing composition enables an improved sensitometric stability to be obtained which does not depend on the reduction of the pH level observed during continuous processing without regeneration. The examples concern emulsions for microfilms.

WO 95/00881 describes stable compounds adapted to the fast development of films for graphic art comprising ascorbic acid or its derivatives of the sugar type or its alkaline salts, and a compound of the 3-pyrazolidinone type or aminophenol.

U.S. Pat. No. 5,264,323 describes compositions for the development of films for graphic art comprising ascorbic acid or its isomers and a compound of the 3-pyrazolidinone or aminophenol type.

EP 461,783 describes a developing composition comprising ascorbic acid or its derivatives, a 3-pyrazolidinone, sulfite or bisulfite and sodium sulfate or glutaraldehyde, which can be used for the development of medical radiographs.

SUMMARY OF THE INVENTION

Thus one of the objects of the present invention is a composition for the development of silver halide photographic products comprising a first developing agent for silver halide, and a co-developing agent that has the formula:

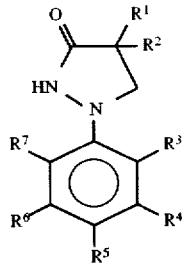

(I)

wherein $R^1$ and $R^2$ independently represent a substituted or non-substituted alkyl group, or a group A—$(X)_p$—A—Sol;

$R^3$ to $R^7$ in formula (I) each separately represent hydrogen, an alkyl, substituted or non-substituted alkoxy or substituted or non-substituted aryloxy group or a group represented by the formula:

$$\leftarrow X)_p-A-(Sol)$$

wherein p=0 or 1; X represents a divalent group chosen from

—O—, —S— and —$NR^8$— wherein $R^8$ is H, alkyl or —A—(Sol);

A represents a divalent group chosen from

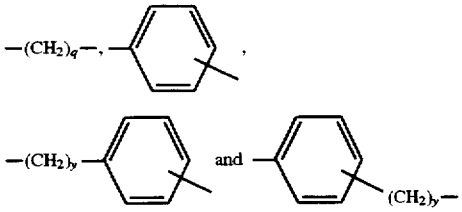

wherein q is between 0 and 5, and y is between 1 and 3;

(Sol) is a solubilizing group chosen from $CO_2H$, $SO_3H$, $NHSO_2R^{10}$, $SO_2NH_2$, $SO_2NHR^{10}$, polyhydroxyalkyl,

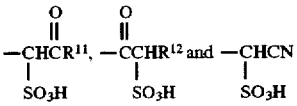

wherein $R^{10}$ is alkyl or aryl, $R^{11}$ is OH, alkyl or aryl and $R^{12}$ is hydrogen, alkyl or aryl;

with the additional condition that at least one of the radicals $R^1$ to $R^7$ must contain a SOL group and that $$\leftarrow X)_p-A-(Sol)$$

cannot represent an ethylmethylsulfonamide radical.

The co-developing agent confers an improved solubility in an aqueous alkaline medium without the superadditivity effect being impaired.

Another object of the invention is a developing composition comprising a first developing agent for silver halides selected from the reductones or the compounds of the hydroquinone type and at least one co-developing agent that is one of the compounds of the 3-pyrazolidinone type described above.

The preferred developing compositions comprise a first developing agent selected from ascorbic acid, derivatives of the ascorbic acid sugar type, stereoisomers, diastereoisomers, precursors of these acids and their salts and at least one co-developing agent which is one of the compounds of the 3-pyrazolidinone type defined above.

DETAILED DESCRIPTION OF THE INVENTION

Figure 1:
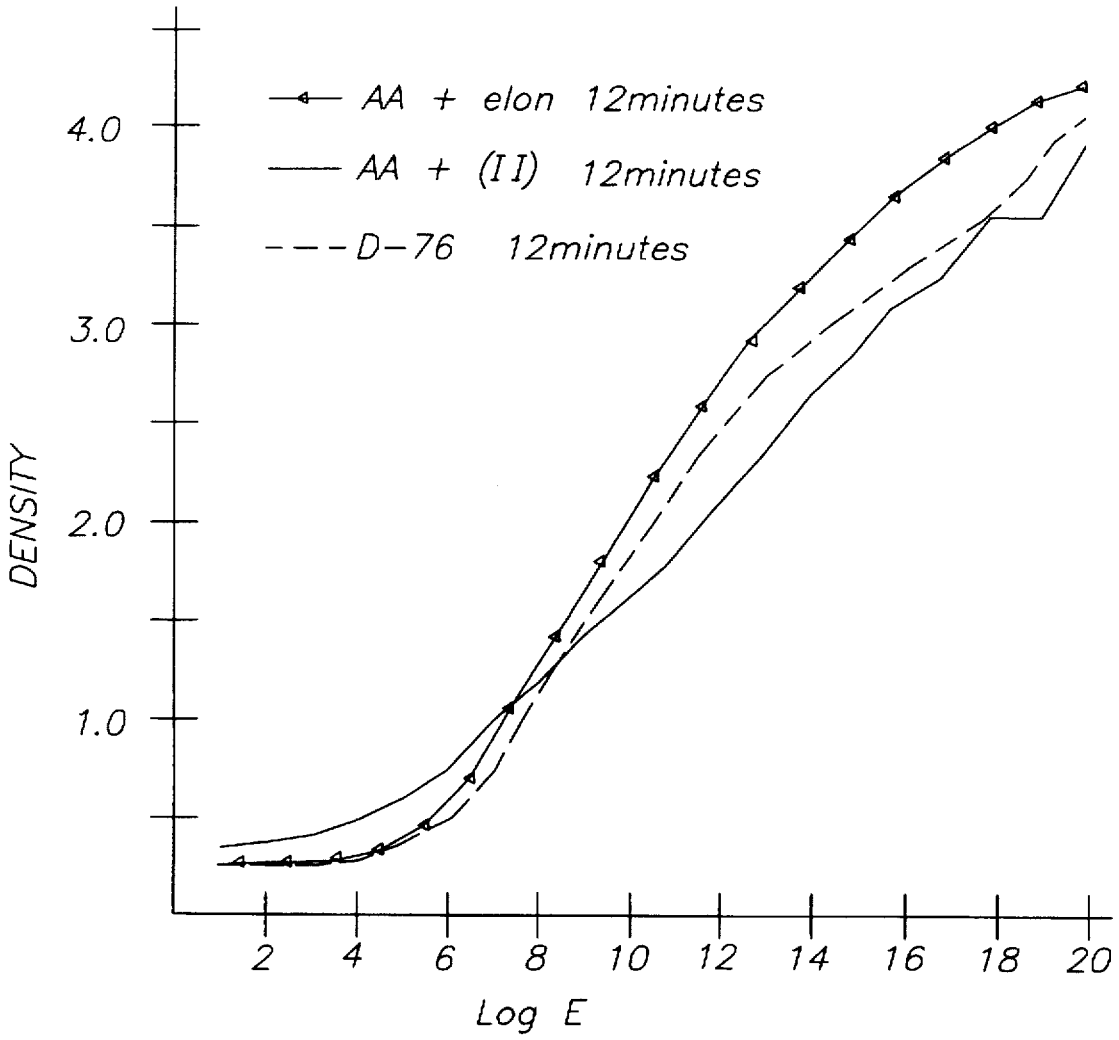
FIG. 1 depicts the sensitometric curves obtained with control developers and with a developer according to the invention comprising ascorbic acid and compound II in a "Slow Access" process for the development of a film of stills.

Black-and-white photographic products can be considered as forming two distinct groups depending on development time. Thus black-and-white films are developed relatively slowly for photography and the cinema, industrial radiographs and black-and-white papers. Typical development times are of the order of 1 to 3 minutes for papers and from 4 to 12 minutes for films. The development temperature is between 18° and 27° C. but can also be higher. This what is referred to as "Slow Access" in the art. A known developer of the "slow access" type is the KODAK D-76® universal developer in powder form, used, for example, for the development of black-and-white films of stills and which contains hydroquinone and Elon®.

The rapid development systems, also referred to as "rapid access" systems, are used for the development of medical radiographs, graphic art and microfilms. These products are developed using very active solutions. The development time is of the order of 30 seconds or less and the development temperature is around 35° C. An example of the "rapid access" type developer is the KODAK RP X-OMAT® developer used for the development of radiographic films, which comprises hydroquinone and phenidone-A as a co-developer. Other "rapid access" developers comprising ascorbic acid and dimezone-S as co-developer are described in *Research Disclosure*, August 1993, Article 35249.

The co-developing agents of the 3-pyrazolidinone type used in this invention have solubilizing groups which are not attached directly to the phenyl ring or to the pyrazolidine ring: these compounds correspond to the general formula:

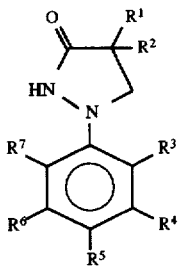

(I)

wherein $R^1$ and $R^2$ independently represent a substituted or non-substituted alkyl group, or a group A—$(X)_p$—A—Sol;

$R^3$ to $R^7$ in formula (I) each separately represent hydrogen, an alkyl, substituted or non-substituted alkoxy or substituted or non-substituted aryloxy group or a group represented by the formula:

$$\leftarrow X)_p - A - (Sol)$$

wherein p=0 or 1; X represents a divalent group chosen from $$-O-,\ -S-\ \text{and}\ -NR^8-$$

wherein $R^8$ is H, alkyl or —A—(Sol);

A represents a divalent group chosen from

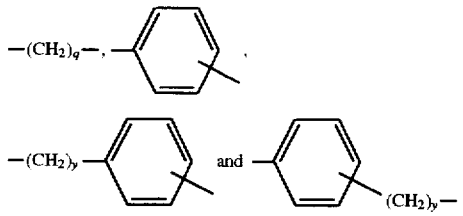

wherein q is between 0 and 5, and y is between 1 and 3;

(Sol) is a solubilizing group chosen from $CO_2H$, $SO_3H$, $NHSO_2R^{10}$, $SO_2NH_2$, $SO_2NHR^{10}$, polyhydroxyalkyl,

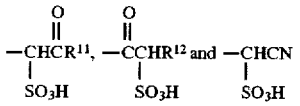

wherein $R^{10}$ is alkyl or aryl, $R^{11}$ is OH, alkyl or aryl and $R^{12}$ is hydrogen, alkyl or aryl;

with the additional condition that at least one of the radicals $R^1$ to $R^7$ must contain a SOL group and that $$\leftarrow X)_p - A - (Sol)$$

cannot represent an ethylmethylsulfonamide radical.

According to a preferred embodiment, the 3-pyrazolidinones have one of the formulae:

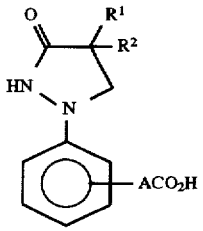

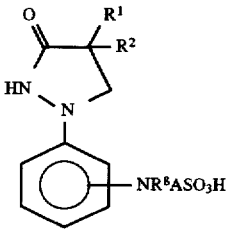

-continued

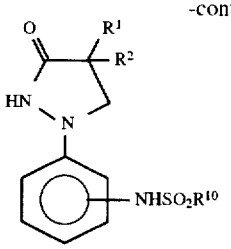

wherein $R^1$, $R^2$, $R^8$, $R^{10}$ and A have the aforementioned signification.

An example of a useful compound has the formula:

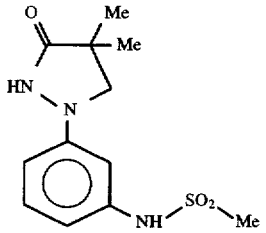

(I)

Another example of a useful compound comprising a solubilizing group attached indirectly to the phenyl ring by means of an alkylene group is 2-(4-(4,4'-dimethyl-3-oxo-pyrazolidinyl)phenyl) acetic acid (Compound II):

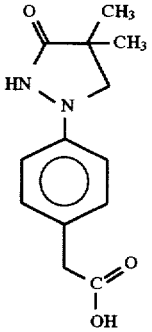

(II)

Other compounds have the formula:

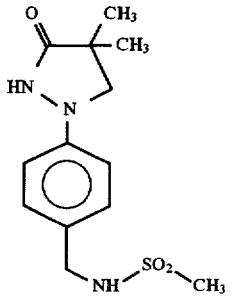

III

-continued
IV
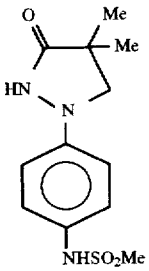
V
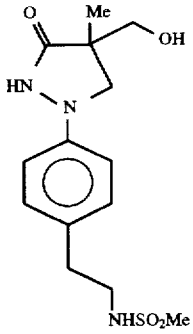
VI
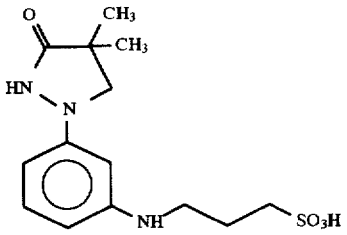
VII
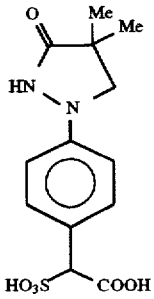
VIII
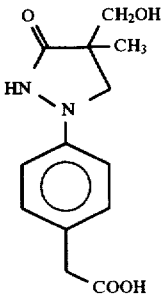
-continued
IX
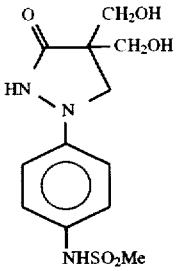
X
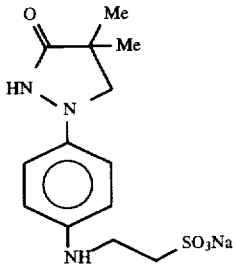
XI
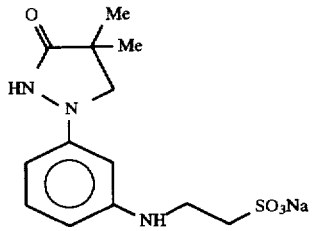
XII
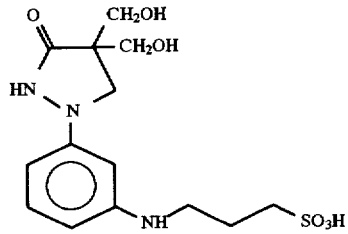
XIII
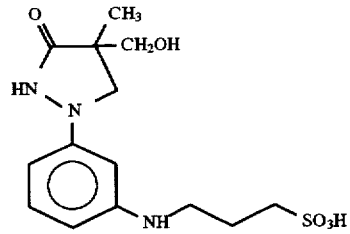
XIV
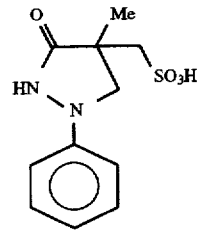

-continued

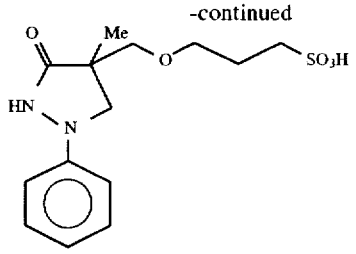

XV

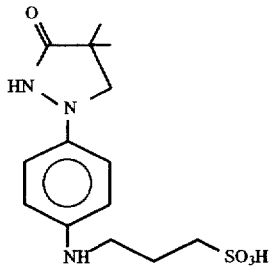

XVI

The invention preferentially concerns developers comprising a developing agent for silver halides chosen from the di- and polyhydroxybenzenes and the reductones and at least one co-developing agent which is one of the compounds of the 3-pyrazolidinone type as defined above.

These compounds can be used as the sole co-developing agent or in a mixture with other compounds or with known aminophenols or phenidones such as Elon®, Phenidone-A, Phenidone-B, Dimezone, Dimezone-S or 4,4-dihydroxymethyl-1-phenyl-5-pyrazolidinone.

In practice, a quantity of co-developing agent of the 3-pyrazolidinone type is used in the developing composition which is, for example, between 0.0005 and 0.2 mol/l, or more, and preferably between 0.005 and 0.06 mol/l of ready-to-use solution.

The compounds of the 3-pyrazolidinone type described herein can be used in developing compositions as "slow access" or "rapid access" co-developing agents in combination with all known first developing agents.

In black-and-white developing solutions, the developing agent is a compound chosen preferably from the di- and polyhydroxybenzenes and reductones. The most widely used dihydroxybenzenes are hydroquinone, catechol and their derivatives. Examples of reductones include ene-diols, ene-animols, ene-diamines, thioenols and enamine-thiols. The most widely used reductones are cited in U.S. Pat. No. 2,691,589, in particular ascorbic acid, its stereoisomers, diastereoisomers and derivatives of the sugar type.

Hydroquinone can be used as a developing agent in the developing compositions according to the invention but in order to protect the environment, ascorbic acid, its sugar-type derivatives, stereoisomers, diastereoisomers, precursors of these acids and their salts are preferred to it.

For example, it is possible to use as a developing agent D-isoascorbic (or erythorbic) acid, L-ascorbic acid and their salts such as sodium or potassium ascorbate or erythorbate; sugar-type derivatives of ascorbic acid such as D-glucoascorbic acid, 6-desoxyl-1-ascorbic acid, L-rhamnoascorbic acid, L-fucoascorbic acid, D-glucoheptoascorbic acid, sorboascorbic acid, ω-lactoascorbic acid, maltoascorbic acid, 1-araboascorbic acid, L-glucoascorbic acid, D-galactoascorbic acid, L-guloascorbic acid and L-alloascorbic, imino-ascorbic and L-gluco-ascorbic acid; the ketal derivatives of ascorbic and isoascorbic acid, for example, 5,6-isopropylene ascorbic acid; and the precursors of ascorbic acid, for example, methyl-2-ketogluconate or a mixture of these.

In practice, a quantity of developing agent of the hydroquinone or ascorbic acid type is used in the developing composition which is between 0.1 and 0.4 mol/l or more, and preferably between 0.15 and 0.30 mol/l of ready-to-use solution.

The developing composition according to the invention can contain, in addition to the developing agent and co-developing agent, numerous conventional additives such as silver halide solvents, alkaline bases, organic or inorganic anti-fog agents, pH buffers, antioxidants, sequestering agents, agents for controlling swelling, hardeners and wetting agents. Within the scope of the invention, the developing composition is amenable to numerous variations accessible to persons skilled in the art in accordance with the envisaged application. These developers can be in the form of a concentrated liquid or in solid form such as powders, tablets or granules, which can be respectively diluted or dissolved in water to obtain the ready-to-use solution.

The co-developing agents described herein have an improved solubility compared with known phenidones. Surprisingly, the presence of these solubilizing groups which are not attached directly to the phenyl ring or to the pyrazolidine ring do not cause the large decrease in super-additivity observed in the article in *Zhurnal Nauchnoi i Prikladnoi Fotografii i kinematografii* already cited. On the contrary, the developing solutions comprising these compounds as co-developing agents have a satisfactory photographic activity.

In addition, the developing agents based on ascorbic acid are also advantageous because they have little tendency to form silver sludges or to cause metallic silver to be deposited on the equipment.

These developing solutions according to the invention can be used for developing black-and-white products, such as graphic art products, radiographic products, black-and-white photographic papers or microfilms or for the black-and-white development stage of reversible color films and papers.

The invention is illustrated by the following examples:

EXAMPLE 1

Synthesis of 2-(4-(4,4'-dimethyl-3-oxo-pyrazolidinyl)phenyl) Acetic Acid (Compound II)

To a suspension of 4-nitrophenylacetic acid (14.9 g, 0.1 mol) and benzyl alcohol (12 g, 0.11 mol) in 230 ml of toluene, p-toluene sulfonic acid monohydrate (0.5 g) is added at room temperature while stirring. The solution is heated to reflux under Dean and Stark conditions for around 22 hours. The solvent is eliminated under reduced pressure and the residual solid is recrystallized in a mixture of toluene and petroleum. After vacuum drying, 21 g (77.5%) of benzyl 4-nitrophenyl acetate (compound 1) is isolated in the form of a whitish solid.

A suspension of compound (1) (5 g, 18.45 mmol) is heated in a mixture of acetic acid (45 ml) and water (5 ml) over a steam bath until the solid dissolves. Iron powder (6 g, 105 mmol) is added in portions over a period of around 10 minutes. Heating is continued for another 1.5 hours after the end of the addition. The hot reaction mixture is poured into water (200 ml) while rapidly stirring, and the mixture is extracted in its entirety with some ethyl acetate (2×200 ml). The combined organic extracts are washed with brine (200 ml) and dried on magnesium sulfate and the solvent is evaporated under reduced pressure in order to obtain a yellow oil (5.8 g). The raw product is dissolved in acetonitrile (70 ml) and gaseous HCl is passed into the solution to saturation point. The solid is collected by filtration and is dried under vacuum in order to obtain 3.4 g (65.4%) of benzyl 4-aminophenylacetate hydrochloride (compound 2) in the form of a cream-colored solid.

A suspension of compound (2) (7.9 g, 28.5 mmol) in a mixture of concentrated HCl (32 ml) and water (11 ml) is cooled to 0° C. A solution cooled in sodium nitrite ice (2.2 g, 31 mmol) in water (6.5 ml) is added to the above suspension for a period of 15 minutes, keeping the internal temperature below 5° C. The mixture is stirred for 10 minutes more before adding a mixture of tin II chloride (23.8 g, 126.2 mmol), concentrated HCl (130 ml) and water (260 ml) at room temperature, stirring rapidly. The solid obtained is collected by filtration and the moist solid is titrated with acetonitrile (150 ml), filtered and dried under vacuum in order to obtain 5.9 g (71%) of benzyl 4-hydrazinophenylacetate hydrochloride (compound 3).

To a solution of compound (3) (7.7 g, 26.3 mol) in dry pyridine (60 ml), 3-chloropivaloyl chloride (4.0 g, 25.5 mol) is added drop by drop for 10 minutes at around 5° C. with stirring. The mixture is then stirred at room temperature for 20 hours before being poured into a mixture of ice and water (600 ml) and concentrated HCl (60 ml). A yellow solid is collected by filtration, washed with water and dried under vacuum on phosphorus pentoxide (8.4 g). The raw product is titrated with cold diethyl ether (80 ml), filtered and dried in air in order to obtain 7.2 g (81%) of benzyl 2-(4-(4,4'-dimethyl-3-oxo-pyrazolidinyl)phenyl acetate (compound 4) in the form of a cream-colored solid.

A solution of compound (4) (3.5 g, 10.35 mmol) is hydrogenated on palladium-containing carbon (0.3 g, 10% Pd) in tetrahydrofuran (270 ml) under 34 atmospheres of hydrogen at room temperature for 24 hours. The catalyst is eliminated by filtration on a kieselguhr buffer and the filtrate evaporated under reduced pressure in order to obtain a yellow gum. The raw product is titrated with diethylether (100 ml), filtered and dried under vacuum. 2.13 g (83%) of 2-(4-(4,4'-dimethyl-3-oxo-pyrazolidinyl)phenyl) acetic acid (compound II) is obtained in the form of a cream-colored solid.

EXAMPLE 2

Synthesis of Compound VI 3-chloropivaloyl chloride (18.1 g, 116.5 mmol) is added to a suspension of 3-nitrophenylhydrazine hydrochloride (22.1 g, 116.5 mmol) in anhydrous pyridine (250 ml). The addition is carried out at 5° C. with stirring. This addition takes 35 minutes. Stirring is then continued at +5° C. for 1 hour, and then at room temperature for a further hour, after which the mixture is heated to reflux under nitrogen for 20 hours. It is cooled to room temperature, and then the suspension is poured into a vigorously stirred mixture of water and ice (2.75 l) and concentrated hydrochloric acid (250 ml). A yellow solid is formed which is collected by filtration and washed in water (2 l). After drying under vacuum and on $P_2O_5$, 24.9 g of a yellow solid, 4,4-dimethyl-1-(3-nitrophenyl-pyrazolidine-3-one), is collected; yield 91%.

A suspension of this product (24.8 g; 105.5 mmol) in tetrahydrofuran (500 ml) is hydrogenated under 32 atmospheres of $H_2$ at 30° C. for 24 hours in the presence of palladium on a substrate of carbon (2 g at 10%). Magnesium sulphate (around 5 g) is added and the mixture is filtered under suction through a kieselguhr buffer. The filtrate is evaporated dry, producing a brown oil. A mixture of t-butanol (250 ml) and anhydrous THF (50 ml) is added. This solution is heated to reflux under an atmosphere of dry nitrogen, while a solution of 1,3-propanesultone (12.9 g; 105.5 mmol) in anhydrous THF (30 ml) is added drop by drop over around 40 minutes, while stirring. The mixture is heated to reflux under nitrogen for a further 20 hours. After cooling to room temperature, a solid forms which is collected by filtration and then dissolved again in acetonitrile (300 ml). This is filtered again and, after drying under vacuum, a cream-colored solid (29.8 g) is obtained. By recrystallization in a mixture of acetonitrile and ethanol and then drying under vacuum, 3-(4,4-dimethyl-3-oxo-pyrazolidine-1-yl)phenylamino-1-propanesulfonic acid (12.3 g; yield 36%) is obtained.

EXAMPLE 3

Slow Access—Ascorbic Acid Developing Agent—Co-developing Agent Compound II

In this example a black-and-white still film is exposed at 2850° K. with a color-corrective filter for 1/25 of a second through a stepped sensitometric wedge. This film is developed for 12 minutes, whilst stirring, at 33° C., fixed for 5 minutes in T-Max® fixative and washed for 10 minutes under running water.

A developing solution according to the invention comprising ascorbic acid as a developing agent and compound II as a co-developing agent is evaluated by comparing it with a commercially available developer KODAK D-76® which comprises hydroquinone and Elon® and with a second control which comprises ascorbic acid and Elon®.

All the developers contain 45 mmol/l of developing agent, 12 mmol/l of co-developing agent and 126 g/l of potassium sulfite and the pH is adjusted to 8.6 by potassium carbonate.

FIG. 1 gives the D(Log E) sensitometric curves obtained for a development time of 12 minutes at 33° C. It can be see that at 33° C. compound II gives a sensitometric curve very close to that obtained when Elon® is associated with hydroquinone.

EXAMPLE 4

Rapid Access—Ascorbic Acid Developing Agent—Co-developing Agent Compound VI

In this example a radiographic film is exposed for 1/50 of a second on both faces through a filter simulating the re-emission of a green screen at 2850° K. This film is developed for 3 minutes at room temperature, manually reproducing the conditions of RP X-OMAT® processing machines, fixed for 2 minutes and washed for 3 minutes in running water.

In this example the control used is the developer whose formula is given in *Research Disclosure* of August 1993, Article 35249, already cited:

| | |
|---|---|
| ascorbic acid | 32.0 g/l |
| dimezone-S (HMMP) | 2.5 g/l |
| benzotriazol | 0.2 g/l |
| KBr | 4.0 g/l |
| $K_2SO_3$ | 50.0 g/l |
| $K_2CO_3$ | 100.0 g/l |
| Na DTPA | 4.3 g/l |
| pH | 10.2 |

*DTPA solution with 40% diethylenetriaminepentaacetic acid.

The developer according to the invention comprises the same constituents, except that compound VI replaces Dimezone-S.

Figure 2:
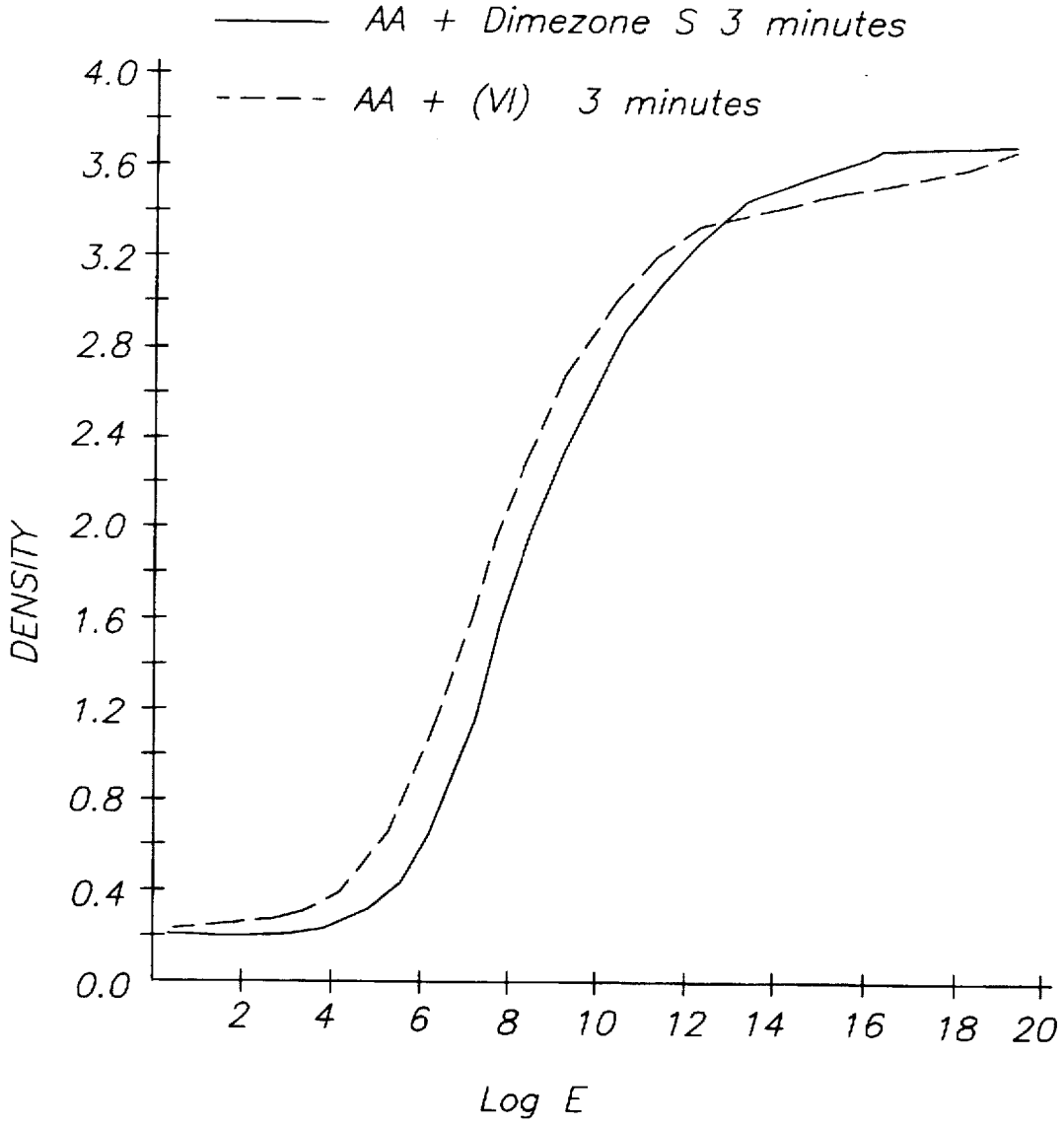
FIG. 2 depicts the sensitometric curves obtained with a control developer and with a developer according to the invention comprising ascorbic acid and compound VI.

FIG. 2 gives the sensitometric curve obtained with compound VI associated with ascorbic acid.

The sensitometric curve is very similar to that obtained with dimezone-S associated with ascorbic acid.

The invention has been described in detail with particular reference to certain preferred embodiments thereof, but it will be understood that variations and modifications can be effected within the spirit and scope of the invention.

We claim:

1. A composition for the development of silver halide photographic products comprising a first developing agent for silver halide, and a co-developing agent that has the formula:

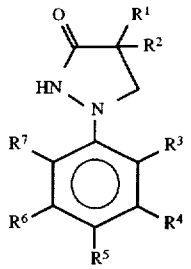

(I)

wherein $R^1$ and $R^2$ independently represent a substituted or non-substituted alkyl group, or a group A—$(X)_p$—A—Sol;

$R^3$ to $R^7$ in formula (I) each separately represent hydrogen, an alkyl, substituted or non-substituted alkoxy or substituted or non-substituted aryloxy group or a group represented by the formula:

$$\leftarrow X\rightarrow_p A \leftarrow Sol)$$

wherein p=0 or 1; X represents a divalent group chosen from

—O—, —S— and —$NR^8$— wherein $R^8$ is H, alkyl or —A—(Sol);

A represents a divalent group chosen from

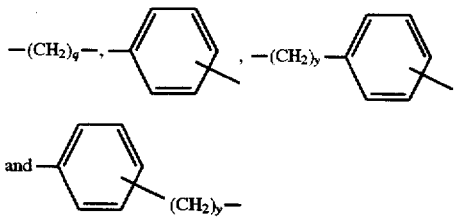

wherein q is between 0 and 5, and y is between 1 and 3;

(Sol) is a solubilizing group chosen from $CO_2H$, $SO_3H$, $NHSO_2R^{10}$, $SO_2NH_2$, $SO_2NHR^{10}$, polyhydroxyalkyl,

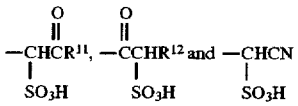

wherein $R^{10}$ is alkyl or aryl, $R^{11}$ is OH, alkyl or aryl and $R^{12}$ is hydrogen, alkyl or aryl;

with the additional condition that at least one of the radicals $R^1$ to $R^7$ must contain a SOL group and that $$\leftarrow X\rightarrow_p A \leftarrow Sol)$$

cannot represent an ethylmethylsulfonamide radical.

2. The composition of claim 1, wherein said co-developing agent is

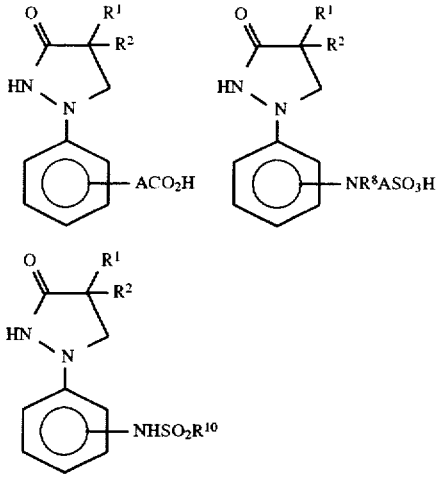

wherein A, $R^8$ and $R^{10}$ are as defined above.

3. The composition of claim 1 wherein said first developing agent is a hydroquinone or a derivative of hydroquinone.

4. The composition of claim 1 wherein said first developing agent is ascorbic acid, a derivative of the sugar type, or a stereoisomer, diastereoisomer or precursor or salt thereof.

5. The composition of claim 1 wherein said co-developing agent is selected from the group consisting of:

I

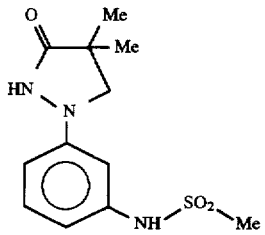

II

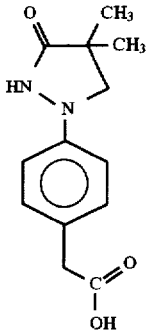

III

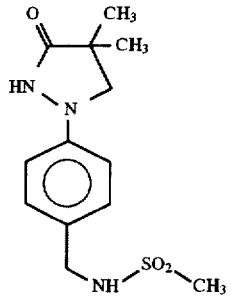

-continued
IV
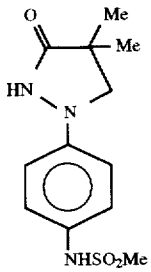
V
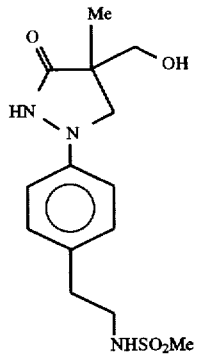
VI
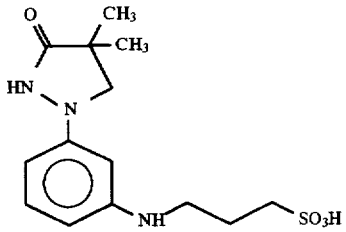
VII
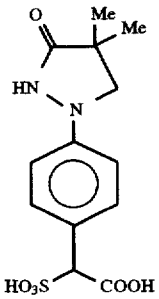
VIII
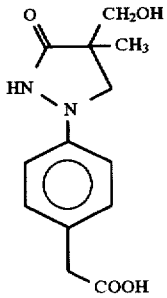
-continued
IX
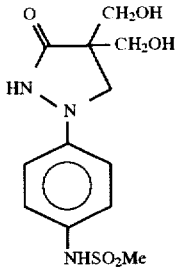
X
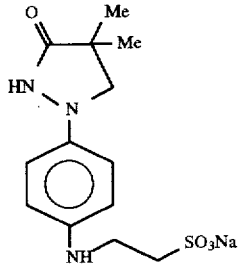
XI
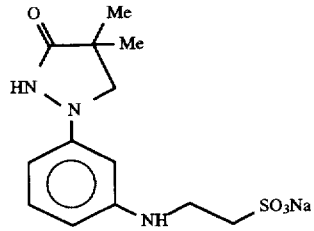
XII
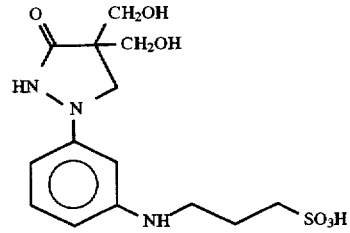
XIII
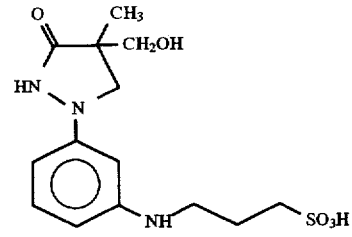
XIV
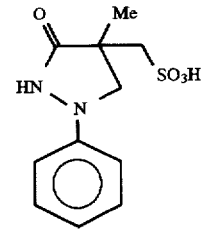
XV
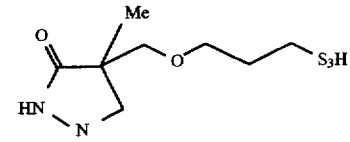

-continued
XVI
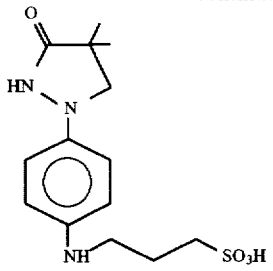
6. The composition of claim 1 wherein said co-developing agent is present at from 0.0005 to 0.2 mol/l.
7. The composition of claim 1 wherein said first developing agent is present at from 0.1 to 0.4 mol/l.
8. The composition of claim 1 in concentrated form.
* * * * *